US009627751B2

(12) United States Patent
Wu et al.

(10) Patent No.: US 9,627,751 B2
(45) Date of Patent: Apr. 18, 2017

(54) DEVICE FOR DECOUPLING ANTENNAS IN COMPACT ANTENNA ARRAY AND ANTENNA ARRAY WITH THE DEVICE

(71) Applicant: The Chinese University of Hong Kong, Hong Kong (CN)

(72) Inventors: Ke-Li Wu, Hong Kong (CN); Luyu Zhao, Xi'an (CN); Lap Kun Yeung, Hong Kong (CN)

(73) Assignee: THE CHINESE UNIVERSITY OF HONG KONG, Hong Kong (CN)

( * ) Notice: Subject to any disclaimer, the term of this patent is extended or adjusted under 35 U.S.C. 154(b) by 598 days.

(21) Appl. No.: 13/691,227

(22) Filed: Nov. 30, 2012

(65) Prior Publication Data

US 2014/0152523 A1 Jun. 5, 2014

(51) Int. Cl.
*H01Q 1/38* (2006.01)
*H01Q 1/52* (2006.01)

(52) U.S. Cl.
CPC ..... *H01Q 1/523* (2013.01)

(58) Field of Classification Search
USPC ..... 343/841, 700 MS, 893
See application file for complete search history.

(56) References Cited

U.S. PATENT DOCUMENTS 7,629,930 B2 * 12/2009 Murch ..... H01Q 1/48 343/700 MS
2007/0069960 A1 * 3/2007 Moon ..... H01Q 1/521 343/700 MS
2008/0136710 A1 * 6/2008 Nefedov ..... H01Q 1/2283 343/700 MS
2008/0204347 A1 * 8/2008 Alvey ..... H01Q 1/52 343/841
2010/0156745 A1 * 6/2010 Andrenko ..... H01Q 1/38 343/848

FOREIGN PATENT DOCUMENTS

CN 102104185 A 6/2011
CN 201893439 U 7/2011

* cited by examiner

*Primary Examiner* — Hoang V Nguyen
*Assistant Examiner* — Hai Tran
(74) *Attorney, Agent, or Firm* — Seed IP Law Group LLP

(57) ABSTRACT

Devices and methods for decoupling two antennas in a compact antenna array and antenna arrays comprising the devices are disclosed. According to an embodiment, the device comprises a first resonator coupled with a source, the source being connected with a first antenna of the two antennas; and a second resonator coupled with the first resonator and a load, the load being connected with a second antenna of the two antennas, wherein the first and second resonators are configured so that a first coupling between the source and the first resonator, a second coupling between the first and second resonators, and a third coupling between the second resonator and the load are satisfied with a constraint that an isolation coefficient in a whole network composed of a first two-port network consisting of the two antennas and a second two-port network consisting of the first and second resonators in parallel approach zero as well as reflection coefficients of each port of the whole network are minimized.

22 Claims, 11 Drawing Sheets

DEVICE FOR DECOUPLING ANTENNAS IN COMPACT ANTENNA ARRAY AND ANTENNA ARRAY WITH THE DEVICE

TECHNICAL FIELD

The present application relates to an antenna decoupling technology, in particular, to devices for decoupling two or more antennas in a compact antenna array and a compact antenna array with such devices.

BACKGROUND

Dramatic advances in next-generation communication systems have inspired portable and compact mobile terminals with increasing channel capacity and throughput. According to the well-known Shannon's theorem, to improve the channel capacity of a communication system, one method is to broaden the system bandwidth, which has been adopted in the third and fourth generation mobile terminals. Another method is to use the multiple-input-multiple-output (MIMO) technology. This technology uses multiple antennas at both transmitter and receiver to improve the channel capacity by several-fold. Therefore, compact and broadband multi-antenna systems are required for future high-capacity mobile terminals.

As the wireless devices are becoming smaller and thinner, multiple antennas in portable terminals have to be implemented in a limited volume of space, and therefore, the spacing between antennas is far less than half-wavelength. This limited spacing will not only increase spatial/pattern correlation but also lead to strong mutual coupling between antennas. High spatial correlation will result in correlated channels and decreased channel capacity, whereas strong mutual coupling reduces radiated power, and thus reduces signal-to-noise ratio and eventually the channel capacity. This issue has drawn a great attention to many world leading companies.

To maintain a compact size of multi-antenna systems and to minimize interference between antennas, effective decoupling techniques need to be developed.

SUMMARY OF INVENTION

According to an aspect of the present application, a device for decoupling two antennas in a compact antenna array is provided, which comprises: a first resonator coupled with a source, the source being connected with a first antenna of the two antennas; and a second resonator coupled with the first resonator and a load, the load being connected with a second antenna of the two antennas, wherein the first and second resonators are configured so that a first coupling between the source and the first resonator, a second coupling between the first and second resonators, and a third coupling between the second resonator and the load are satisfied with a constraint that isolation coefficients in a whole network composed of a first two-port network consisting of the two antennas and a second two-port network consisting of the first and second resonators in parallel approach zero as well as reflection coefficients of each port of the whole network are minimized.

In embodiments of the application, self-couplings of the resonators and/or further couplings in the device may be further adjusted so as to make the above constraint to be satisfied in more complex situations.

In embodiments of the application, the device may be implemented by substrate technologies such as LTCC or multi-layered PCB.

In embodiments of the application, the inter-resonator coupling may be fixed, while input/output couplings may be adjustable, so that the device may be implemented as a one-fit-all universal component which is applicable for antennas with different parameters from each other.

In embodiments of the application, a third resonator and a fourth resonator may be further provided in parallel or in series with the first and second resonators to achieve dual-band decoupling.

In embodiments of the application, transmission lines and/or matching network may be further provided.

According to another aspect of the present application, a device for decoupling a plurality of antennas in a compact antenna array is provided, which comprises: a plurality of resonators, each of which is coupled with a respective port connected with each of the plurality antennas, wherein coupling coefficients in the device are adjusted to satisfy with a constraint that isolation coefficients in a whole network composed of a first multi-port network consisting of the compact antenna array and a second multi-port network consisting of the plurality of resonators in parallel approach zero as well as reflection coefficients of each port of the whole network are minimized.

According to a further aspect of the present application, an antenna array comprising a plurality of antennas is provided, wherein a device according to the present application is arranged between at least two of the plurality of antennas.

BRIEF DESCRIPTION OF DRAWINGS

FIG. 8(*b*) is simulated and measured S-parameter of the array of FIG. 8(*a*) showing the isolation and reflection of the array without a decoupling network.

FIG. 9(*b*) is simulated and measured S-parameter of the array of FIG. 9(*a*) showing the decoupling and matching performance of the array.

FIG. 10(*b*) is simulated and measured S-parameter of the array of FIG. 10(*a*) showing the decoupling and matching performance of the array.

FIG. 11(*b*) is simulated and measured S-parameter of the array of FIG. 11(*a*) showing the decoupling and matching performance of the array.

DETAILED DESCRIPTION OF EMBODIMENT(S) OF THE INVENTION

Hereinafter, embodiments of the application will be described with reference to the accompanying drawings. To be specific, descriptions are given of (1) Structure of Decoupling Networks, (2) Setting of Coupling Coefficients, (3) Effects and Advantages, (4) Experimental Results, (5) Dual-band decoupling networks, and (6) Three-element Decoupling Networks for Three Coupled Antennas.

Structure of Decoupling Networks

Figure 1:
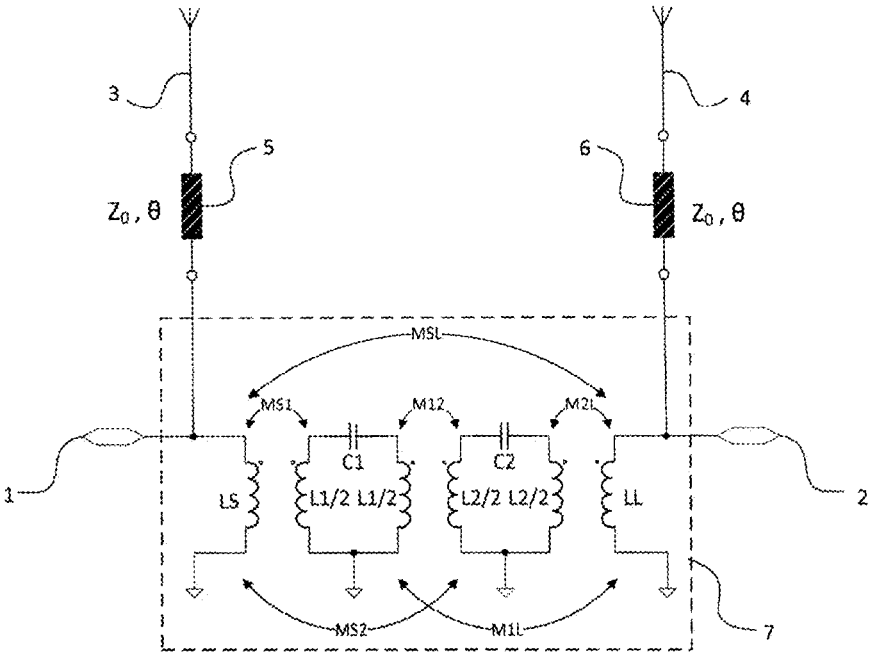
FIG. 1 illustrates a schematic configuration of an embodiment according to the present application.

FIG. 1 illustrates a schematic configuration of an embodiment according to the present application. As known, a multi-antenna network comprises a plurality of closely disposed antennas. Hereinafter, a two-antenna network comprising two closely disposed antennas will be taken as an example to explain the application. It will be understood that, for an antenna network comprising more than two antennas, the configuration discussed below could be used for each two of the antennas. It will also be understood that, for an antenna network comprising more than two antennas, an alternative method is to design a multi-port decoupling network. A three port decoupling network to decouple three-element arrays will be given as an example. Both of these two methods equivalently generate a second path of controllable mutual coupling to cancel out the existing antenna to antenna mutual coupling in a broadband sense.

As shown in FIG. 1, the two-antenna network comprises two closely disposed antennas 3, 4. One end of the antenna 3 is connected to a port 1 to transmit/receive data to/from the apparatus such as a mobile terminal in which the antenna network is installed. One end of the antenna 4 is connected to a port 2 to transmit/receive data to/from the apparatus in which the antenna network is installed. The other end of each of the antennas 3 and 4 is configured to transmit/receive data to/from other apparatus such as other mobile terminals or the base station. Hereinafter, for the purpose of easy explanation, the two ports 1 and 2 may also be referred to as an input port and an output port, respectively.

According to the present application, a decoupling network (or decoupling device) composed of two resonators or resonant loops is provided between the source and the load. The decoupling between the two antennas 3 and 4 is implemented by setting a coupling coefficient between the source and the first resonator (L1, C1), a coupling coefficient between the first resonator (L1, C1) and the second resonator (L2, C2), and a coefficient between the second resonator and the load based on a constraint that the mutual admittances in a whole network composed of the two-port antenna network and the two-port decoupling network approach zero, meanwhile the self-admittances approach to the characteristic admittance of ports 1 and 2.

As shown in FIG. 1, the couplings of the source and the load ports are illustratively represented by a zero inductor LS and a zero inductor LL respectively. The coupling coefficient $m_{S1}$ and $m_{2L}$, which are the coupling of the source port to the first resonator and the coupling of the second resonator to the load port respectively, can be implemented by capacitive couplings, inductive couplings and the mixture of both. According to different characteristics of the antenna coupling, proper type of couplings can be determined.

In FIG. 1, a transmission line 5 is inserted between the antenna 3 and the source LS and another transmission line 6 is similarly inserted between the antenna 4 and the load LL. Such a configuration may lead to a better isolation performance between the coupled antennas. It is noted that the transmission lines 5, 6 are not necessarily required for some coupled antennas according to this application.

As an example, the first resonant loop (L1, C1) in FIG. 1 is illustratively composed of a capacitor C1 and two inductors L1/2, and the second resonant loop (L2, C2) in FIG. 1 is illustratively composed of a capacitor C2 and two inductors L2/2. It is noted that the resonant loops may also be composed in other forms. According to the present application, the specific values of inductors and/or capacitors are unimportant, as long as the resonant frequency of the resonant loop is appropriate with respect to the coupled antennas and that the desired coupling coefficients are obtained.

Figure 2:
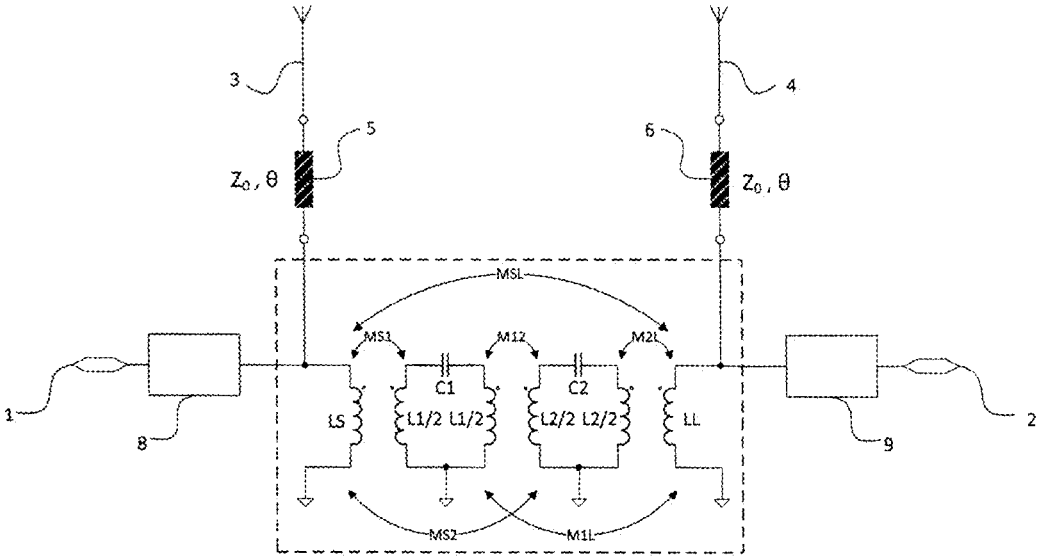
FIG. 2 illustrates a schematic configuration of another embodiment according to the present application.

FIG. 2 shows an embodiment of the present application, in which a matching network 8, 9 is additionally provided at each of the ports 1, 2. The matching elements may be implemented by lumped elements or transmission line stubs to further broaden the matching bandwidth.

According to the present application, the decoupling network may be implemented by using different technologies, including LTCC (Low Temperature Co-fired Ceramic) and multi-layered PCB. An illustrative example of a decoupling network in the form of a double-layered PCB will be given hereinafter.

The decoupling network according to the present application may be implemented by using lumped elements or distributed elements or mixture of both as long as desired coupling coefficients are obtained.

According to the present application, the two antennas may be identical or different. In the case of two antennas being identical, the two resonators may also be identical with each other. Otherwise, the two resonators may be in different resonant frequency with one another. Two illustrative prototype examples are shown in FIGS. 3 (identical) and 4 (different).

Figure 3:
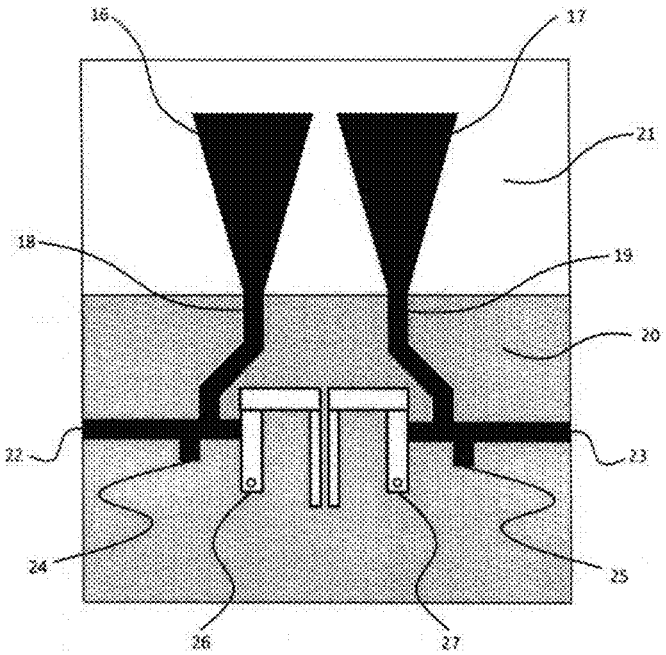
FIG. 3 illustrates a physical structure of an embodiment according to the present application applicable for an illustrative symmetrical antenna array.

In FIG. 3, the first cone-shaped antenna 16 is strongly coupled to the second cone-shaped antenna 17, which is identical to the antenna 16. To have a better decoupling performance, two sections of transmission lines 18 and 19 are inserted. Resonator 26 and resonator 27 are then included together with matching network 24 and 25. The port 22 and port 23 are decoupled and become uncorrelated. The substrate 21 in this prototype is a double layered FR4 PCB and the ground 20 can take various forms according to the size and dimension of the mobile terminals.

Figure 4:
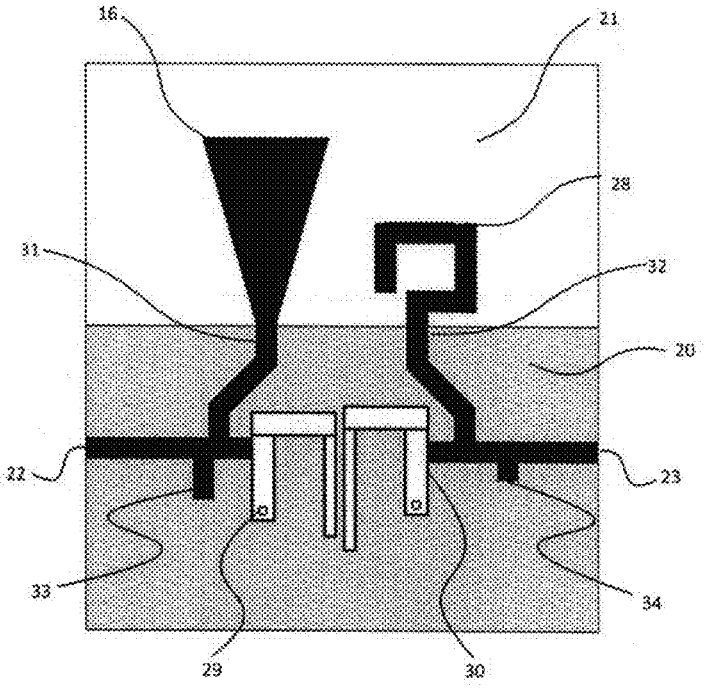
FIG. 4 illustrates a physical structure of an embodiment according to the present application applicable for an illustrative asymmetrical antenna array.

Similarly, for the case shown in FIG. 4, the same cone-shaped antenna 16 is coupled to a meander line monopole antenna 28. Two sections of transmission lines 31 and 32 are inserted. Since the coupled antennas are different, the two resonators 29 and 30 resonate at different frequencies. Meanwhile, the matching network 33 for port 22 and matching network 34 for port 23 are also different. The substrate 21 in this prototype is a double layer FR4 PCB and the ground 20 can take various forms according to the size and dimension of the mobile terminals.

Figure 5:
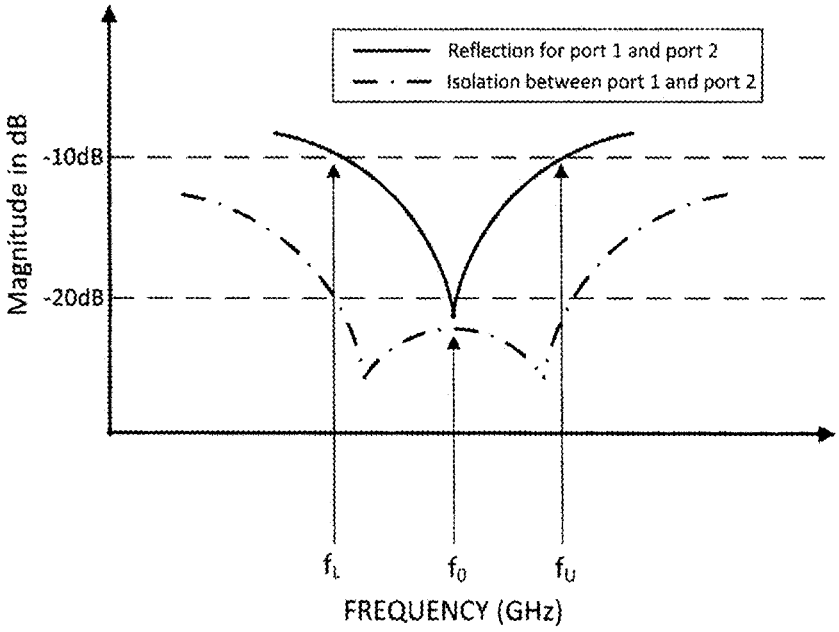
FIG. 5 shows expected decoupling and matching results for a decoupled symmetrical antenna array for illustrative purpose.
Figure 6:
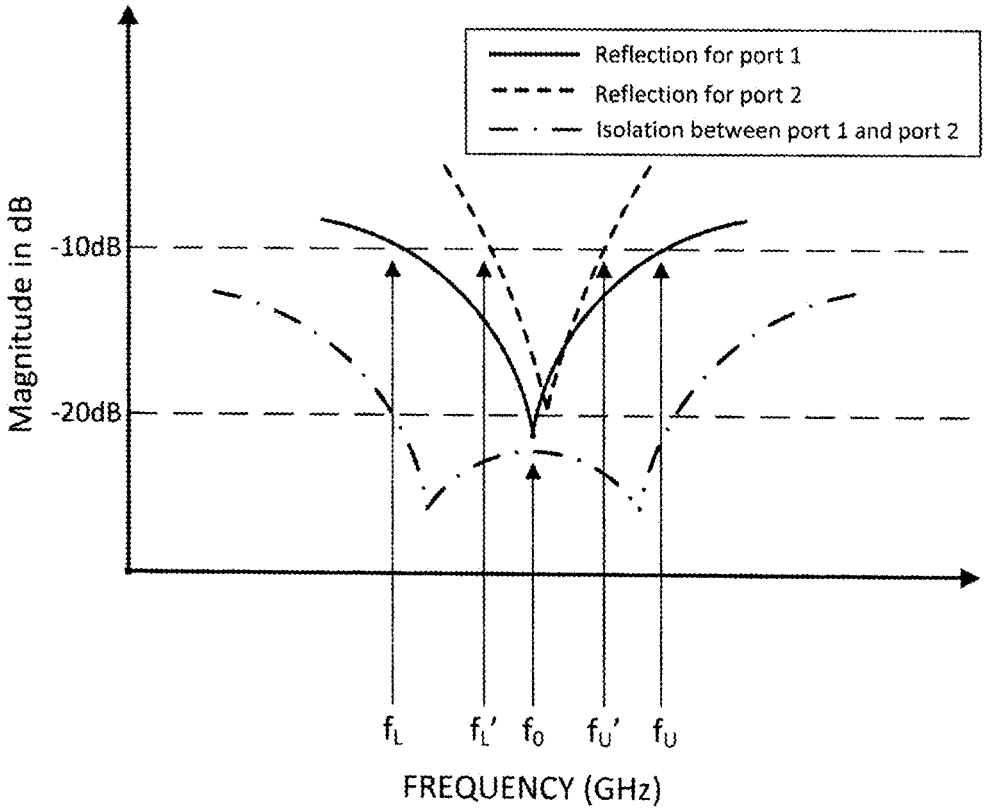
FIG. 6 shows expected decoupling and matching results for a decoupled asymmetrical antenna array for illustrative purpose.

FIGS. 5 and 6 illustrate expected results for the decoupled identical and non-identical antennas, respectively. As shown in FIG. 5, the solid line represents reflection coefficients of the ports 1, 2, while the dot-and-dash line represents isolation between the ports 1, 2. The center frequency is indicated as $f_0$, and the lower and upper frequencies of both ports are indicated as $f_L$ and $f_U$, respectively. FIG. 6 is similar to FIG. 5, except that the frequency ranges of ports 1, 2 are different from each other. In particular, the lower and upper frequencies of port 1 are indicated as $f_L$ and $f_U$, respectively, while the lower and upper frequencies of port 2 are indicated as $f_L'$ and $f_U'$, respectively. Accordingly, the reflection coefficient of the ports 1, 2 are different from each other and represented by the solid line and the dash line, respectively.

The isolation between the ports 1, 2 reflects coupling/decoupling degree between the ports. The reflection coefficient of each port reflects matching performance of the port. As shown in FIGS. 5 and 6, according to the decoupling network of the present application, the reflection and isolation for both ports would satisfy the desired conditions, and thus desired decoupling and matching could be obtained in the frequency range of interest.

The actual matching bandwidth also depends on the bandwidth of a particular antenna.

As mentioned above, the decoupling network according to the present application may be composed of resonators in any suitable form by substrate technologies such as LTCC or multi-layered PCB.

Setting of Coupling Coefficients

Hereinafter, setting of the coupling coefficients will be described.

In a configuration according to the present application as shown in FIG. 1, the following coupling coefficients may be considered in designing the network:

- $m_{S1}$: The coupling coefficients between the source and the resonator 1;
- $m_{12}$: The coupling coefficients between the resonator 1 and resonator 2;
- $m_{2L}$: The coupling coefficients between the resonator 2 and the load;
- $m_{SL}$: The coupling coefficients between the source and the load;
- $m_{S2}$: The coupling coefficients between the source and the resonator 2;
- $m_{1L}$: The coupling coefficients between the resonator 1 and the load;
- $m_{11}$: The self-couplings of resonator 1 that is proportional to the frequency shift of the resonator 1 from the center frequency;
- $m_{22}$: The self-couplings of resonator 2 that is proportional to the frequency shift of the resonator 2 from the center frequency.

Figure 10A:
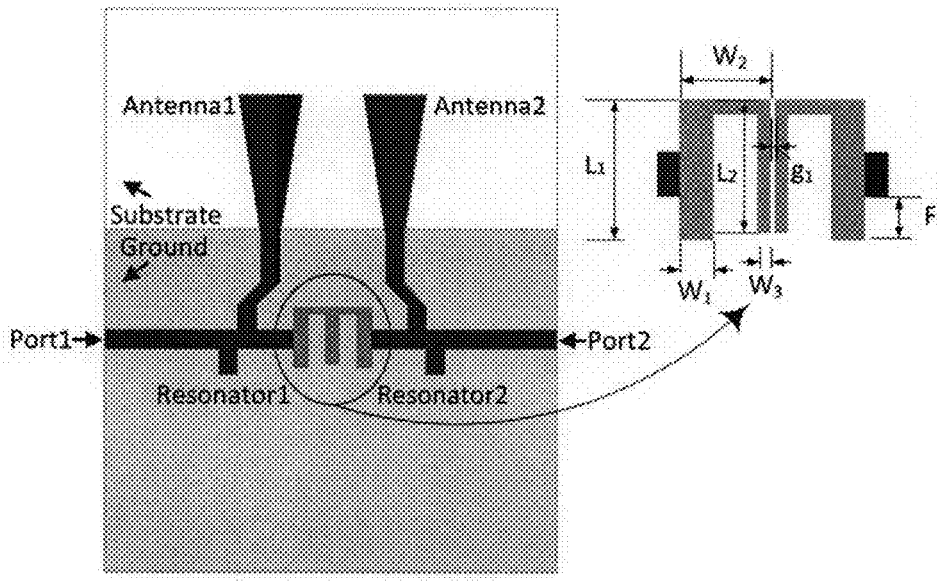
FIG. 10(*a*) is an illustrative symmetrical antenna array with a decoupling network according to the present application added.
Figure 10B:
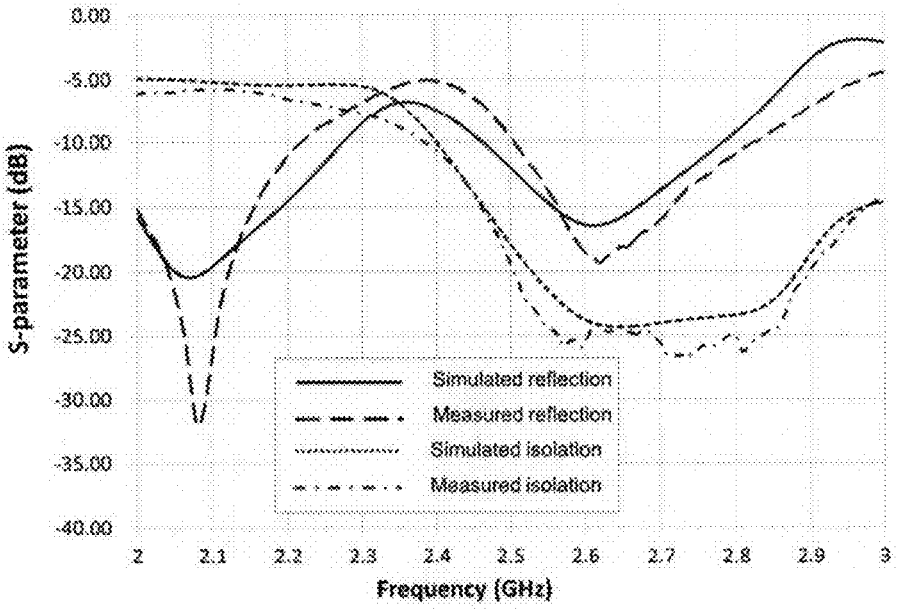

According to an embodiment, the first three coefficients $m_{S1}$, $m_{12}$ and $m_{2L}$ among the above eight coupling coefficients are considered. As long as the three coefficients are appropriately adjusted, the coupling between two identical antennas in a symmetrical compact antenna array through air is cancelled or at least significantly released so that the decoupling is achieved. It will be understood that, since the antenna array is symmetric, the decoupling network should also be symmetric, which means that $m_{S1}=m_{2L}$. An example is shown in FIG. 10(*a*).

Figure 9A:
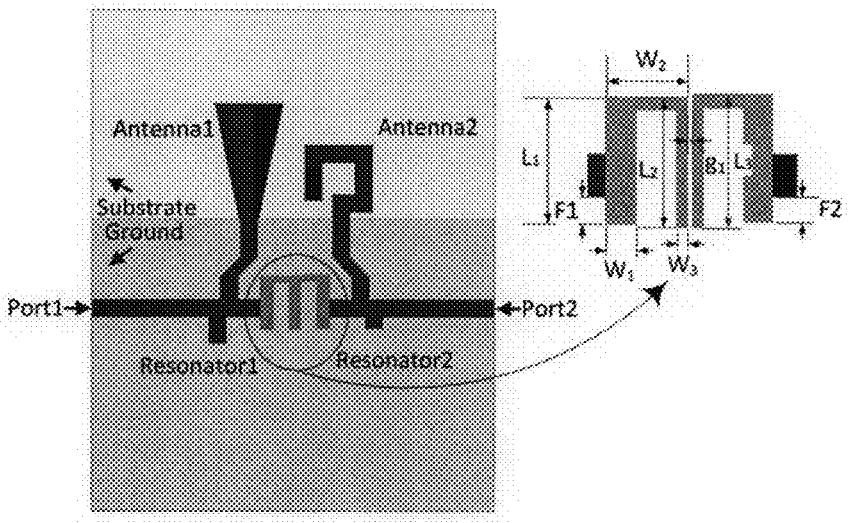
FIG. 9(*a*) is an illustrative asymmetrical antenna array of FIG. 8(*a*) with a decoupling network according to the present application added.
Figure 9B:
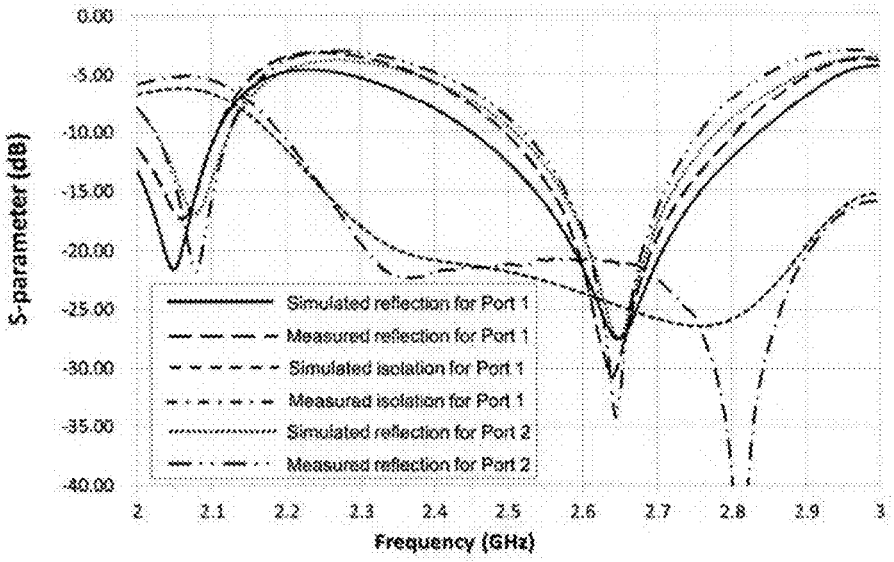

According to another embodiment, the self-coupling coefficients $m_{11}$ and $m_{22}$, in addition to the above three coefficients, are further considered to decouple an asymmetrical antenna array. It will be understood that, since the antenna array is asymmetric, the decoupling network should also be asymmetric, which means that $m_{S1}{}^1$ $m_{2L}$ and $m_{11}{}^1$ $m_{22}$. An example is shown in FIG. 9(*a*).

Figure 11A:
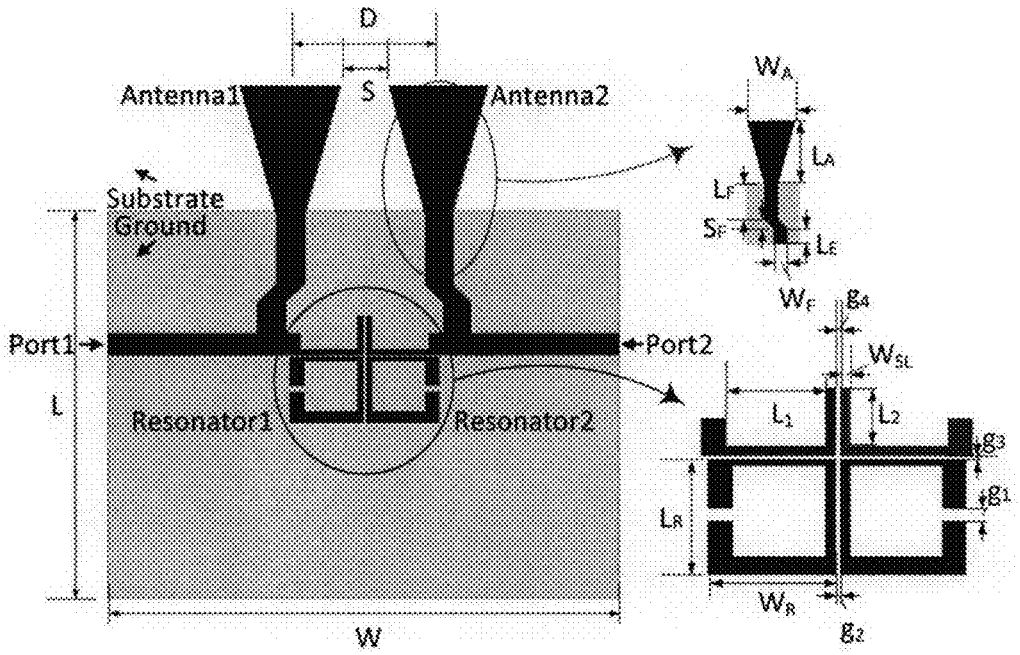
FIG. 11(*a*) is an illustrative antenna array with a decoupling network with all eight coupling coefficients according to the present application added.
Figure 11B:
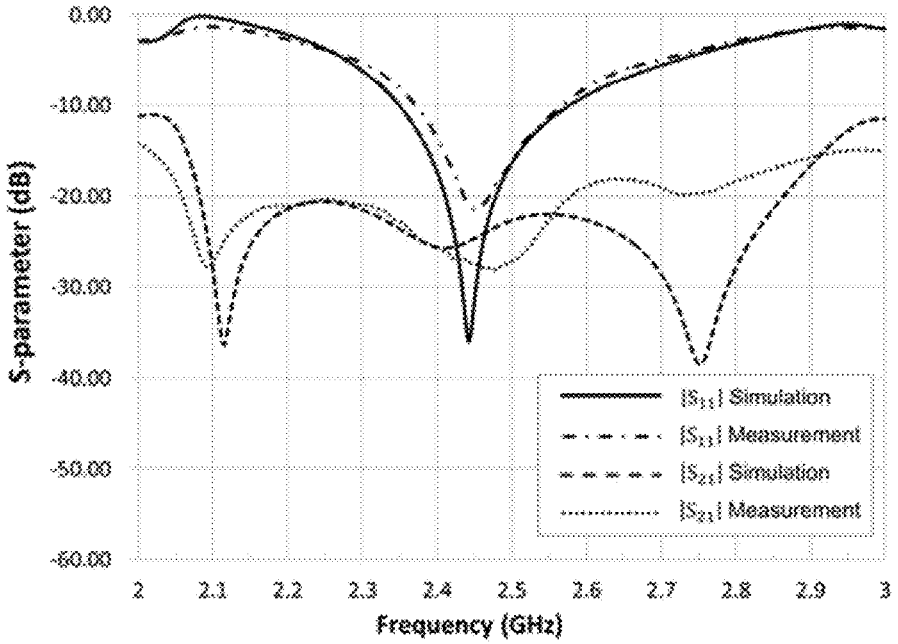

According to a further embodiment, the coefficients $m_{S2}$, $m_{1L}$, and $m_{SL}$, in addition to the above five coefficients, are further considered for coupled antennas in severe conditions. For example, if the mutual coupling of the coupled antennas significantly varies in the frequency band of interest, all eight coupling coefficients need to be considered. An example is shown in FIG. 11(*a*).

According to the present application, the above coupling coefficients are determined based on a constraint that the mutual admittances in a whole network composed of the two-port antenna network and the two-port decoupling network in parallel approach zero, meanwhile the self-admittances approach the characteristic admittance of ports 1 and 2. In particular, for a given two-port antenna network, a 2×2 admittance matrix $$Y^A = \begin{bmatrix} Y_{11}^A & Y_{12}^A \\ Y_{21}^A & Y_{22}^A \end{bmatrix}$$

of the antenna network is known. Where a two-port decoupling network with a 2×2 admittance matrix $$Y^F = \begin{bmatrix} Y_{11}^F & Y_{12}^F \\ Y_{21}^F & Y_{22}^F \end{bmatrix}$$

is added in parallel with the antenna network, the admittance matrix of the whole network is the sum of the two individual admittance matrices as $$Y = \begin{bmatrix} Y_{11} & Y_{12} \\ Y_{21} & Y_{22} \end{bmatrix} = \begin{bmatrix} Y_{11}^A + Y_{11}^F & Y_{12}^A + Y_{12}^F \\ Y_{21}^A + Y_{21}^F & Y_{22}^A + Y_{22}^F \end{bmatrix}.$$

Since the decoupling network is assumed to be lossless, the entries in its admittance matrix $Y^F$ are all purely imaginary.

Under a constraint that the mutual admittances in a whole network composed of the two-port antenna network and the two-port decoupling network approach zero, meanwhile the self-admittances approach the characteristic admittance of ports 1 and 2, the decoupling and matching conditions are expressed as:

$$Re\{Y_{21}^{A}(f)\}\approx 0$$

$$j\cdot Im\{Y_{21}^{A}(f)\}+Y_{21}^{F}(f)\approx 0.$$

and $$Re\{Y_{kk}^{A}(f)\}\approx 1,\ k=1,2,$$

$$j\cdot Im\{Y_{kk}^{A}(f)\}+Y_{kk}^{F}(f)\approx 0,\ k=1,2.$$

where f is the bandpass frequency in Hz.

The scattering parameters of the overall network are related to the admittance parameters in the following way:

$$S_{11}=\frac{(1-Y_{11})(1+Y_{22})+Y_{12}Y_{21}}{(1+Y_{11})(1+Y_{22})-Y_{12}Y_{21}}$$

$$S_{21}=\frac{-2Y_{21}}{(1+Y_{11})(1+Y_{22})-Y_{12}Y_{21}}$$

$$S_{22}=\frac{(1+Y_{11})(1-Y_{22})+Y_{12}Y_{21}}{(1+Y_{11})(1+Y_{22})-Y_{12}Y_{21}}$$

Therefore, the decoupling and matching conditions can also be expressed by scattering parameters. In particular, the decoupling condition could be: the isolation coefficients of the two-port network are lower than a predefined level, for example, 20 dB; and the matching condition could be: the reflection coefficients of the whole network are lower than another predefined level, for example, 10 dB.

Figure 8A:
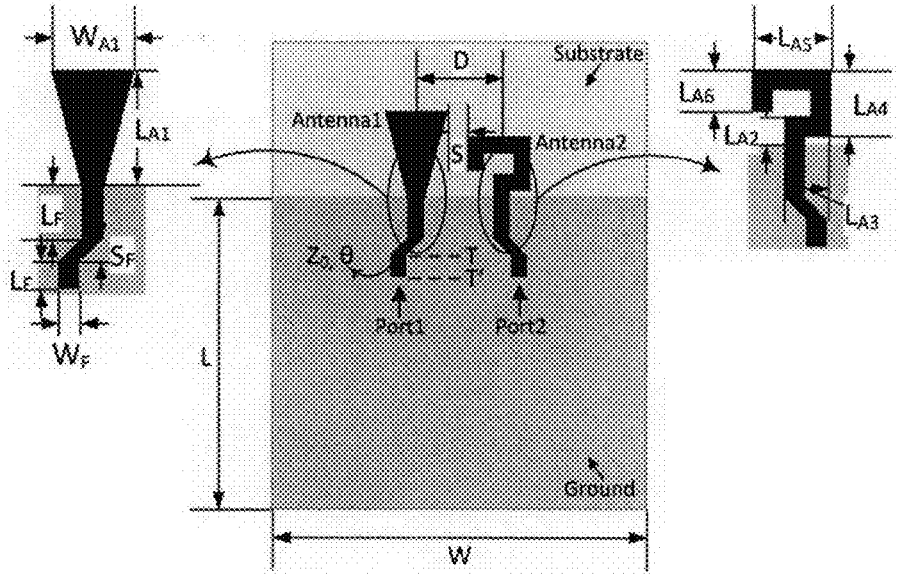
FIG. 8(*a*) is an illustrative asymmetrical antenna array without a decoupling network.
Figure 8B:
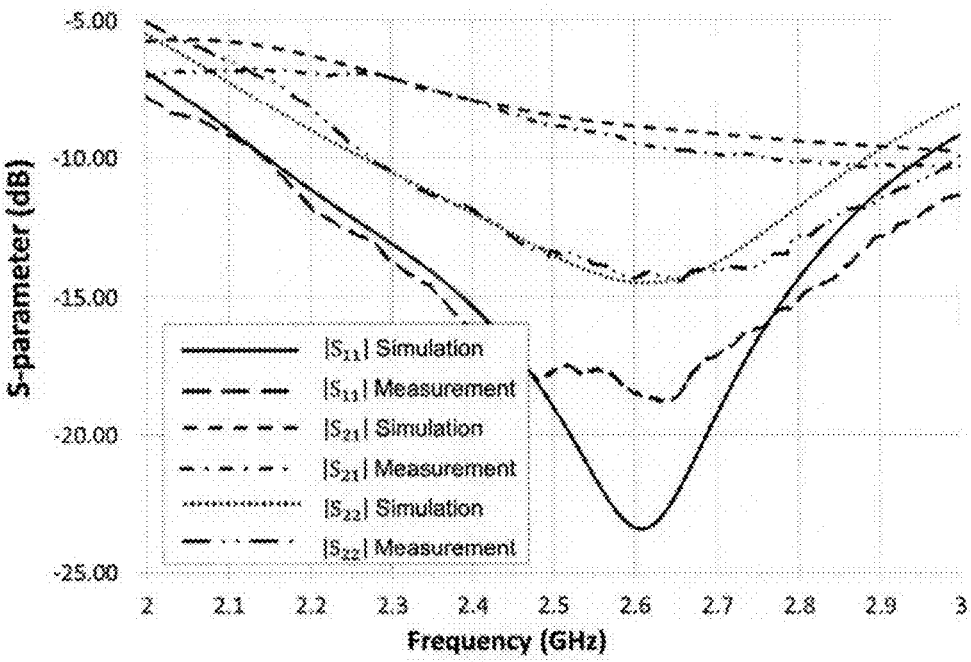

Simulated and measured scattering parameters of the prototypes in FIG. 9(*a*), FIG. 10(*a*), and FIG. 11(*a*) are shown in FIG. 9(*b*), FIG. 10(*b*), and FIG. 11(*b*) respectively. It is noted that FIG. 9(*a*) is an illustrative asymmetrical antenna array of FIG. 8(*a*) with a decoupling network according to the present application added. Simulated and measured S-parameter of the array of FIG. 8(*a*) illustrated in FIG. 8(*b*) show the isolation and reflection of the array without a decoupling network.

Figure 7:
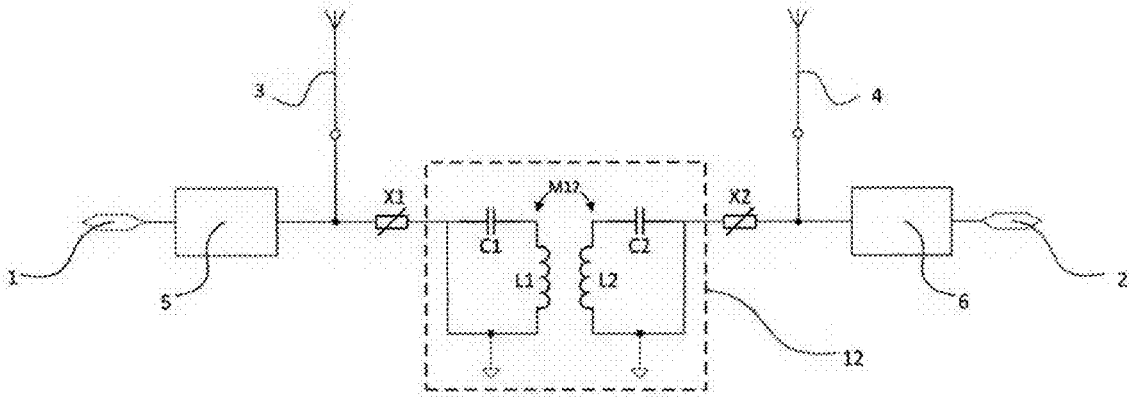
FIG. 7 illustrates a schematic configuration of another embodiment according to the present application, which is a one-fit-all decoupling module.

It is demonstrated from theoretical analysis that to achieve broadband decoupling performance, it is preferable to set the coupling coefficient $m_{12}$ to be as large as possible and fixed and set the coupling coefficients $m_{S1}$ and $m_{2L}$ to be adjustable when designing the coupling coefficients, so that the decoupling network may be used as a one-fit-all component for various antenna networks having different admittance parameters as shown in FIG. 7.

After the desired coupling coefficients are determined, the skilled artisian may implement the decoupling network in any suitable forms. For example, (1) the lumped element resonators; (2) the quasi-lumped resonators such as LTCC multi-layered resonators; (3) the short circuit quarter wavelength resonators such as U shape folded resonators and step-impedance resonators; (4) the open circuit half wave length resonators, such as the open-loop ring resonators and end coupled half wave resonators.

Although calculation of the coupling coefficients have been discussed, it is possible that the coupling coefficient is not determined by the mentioned theory. According to the present application, coupling coefficients may be optimized or adjusted arbitrarily until a desired decoupling performance is achieved.

EFFECTS AND ADVANTAGES

According to the present application, decoupling between the antennas is implemented after the above coupling coefficients of the decoupling network are appropriately designed.

In particular, for a symmetrical antenna array, if a decoupling network according to the present application with appropriately adjusted coefficients $m_{S1}$, $m_{12}$ and $m_{2L}$ is added in parallel with the antenna array, mutual coupling between antennas in the antenna array will be minimized or at least significantly reduced.

For an asymmetrical antenna array, if a decoupling network according to the present application with appropriately adjusted coefficients $m_{S1}$, $m_{12}$, $m_{2L}$, $m_{11}$ and $m_{22}$ is added in parallel with the antenna array, mutual coupling between antennas in the antenna array will be minimized or at least significantly reduced.

For coupled antennas in severe conditions, for example, when mutual coupling of the coupled antennas significantly varies in the frequency band of interest, a decoupling network according to the present application with appropriately adjusted coefficients $m_{S2}$, $m_{1L}$, and $m_{SL}$, in addition to the above three or five coefficients (corresponding to situations of symmetrical or asymmetrical antenna configurations, respectively) is added in parallel with the antenna array, mutual coupling between antennas in the antenna array will be minimized or at least significantly reduced.

Such effects and advantages will be further verified with reference to the following experimental results.

Experimental Results

Experiments have been carried out to verify the performance of the decoupling network proposed in the application.

In the following example, the proposed decoupling theory is applied to a symmetric array, in which a pair of symmetric broadband monopole antennas is considered. The edge to edge spacing (S) between the two elements is 9.8 mm ($0.084\lambda_0$).

Since $Im\{Y_{11}^{A}\}$ and $Im\{Y_{22}^{A}\}$ are identical, a symmetric decoupling network can be synthesized and designed. The physical dimensions of the resonators are found to be: $L_1$=9.5 mm, $L_2$=9 mm, $W_1$=2.2 mm, $W_2$=6 mm, $W_3$=0.8 mm, and $g_1$=0.35 mm. The tapped-line feeding position (F) is 2.9 mm, which is depicted in FIG. 10(*a*). Two extra matching stubs are added to improve the matching performance. Simulation and measurement results are shown in FIG. 10(*b*) with the realized coupling coefficients are: $m_{S1}=m_{2L}=1.2421$ and $m_{12}=2.7142$. The decoupling bandwidth with $|S_{21}|\leq -20$ dB is about 15% and the matching bandwidth with $|S_{11}|\leq -10$ dB and is about 12%, showing that a second-order decoupling network can achieve a much wider decoupling bandwidth as compared to technologies in prior art.

The envelope correlation coefficients and efficiencies are two figures of merit of the decoupling network. For any pairs of antennas with low isolation and reflection, these two quantities must be good enough in the frequency band of interest.

Figure 12:
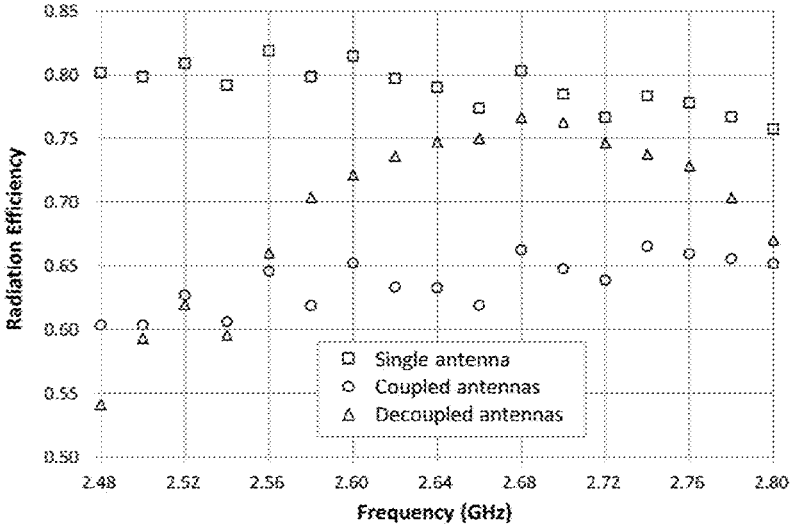
FIG. 12 shows the measured radiation efficiencies of a single antenna, coupled antennas shown in FIG. 8(*a*) and decoupled antennas shown in FIG. 9(*a*).

The efficiency can be obtained by a far-field radiation measurement. The measured efficiencies shown in FIG. 12 show that within the operating frequency band of the decoupling network, the overall efficiency of the decoupled array is improved by about 10% as compared to the coupled array case without a decoupling network.

Meanwhile, the envelop correlation coefficient of a diversity antenna system in a Rayleigh fading channel is defined as $$\rho_e=\frac{\left|\iint_{4\pi}\left[\vec{E}_1(\theta,\phi)\cdot\vec{E}_2(\theta,\phi)\right]d\Omega\right|^2}{\iint_{4\pi}\left|\vec{E}_1(\theta,\phi)\right|^2 d\Omega\iint_{4\pi}\left|\vec{E}_2(\theta,\phi)\right|^2 d\Omega}$$

Figure 13:
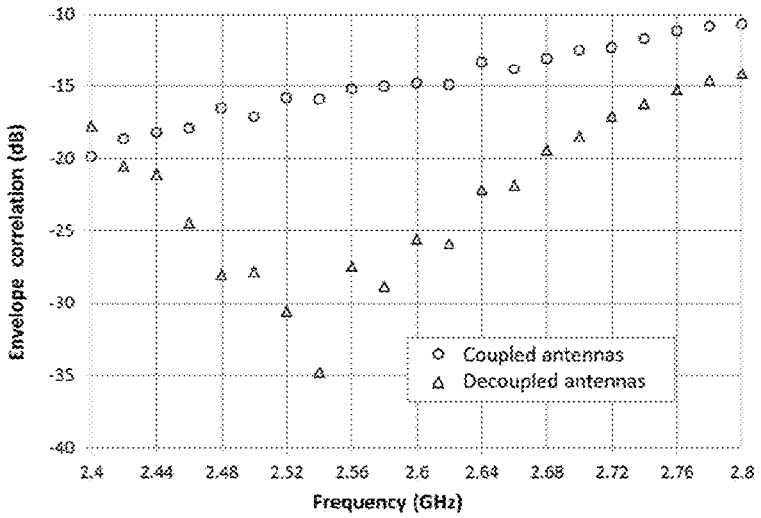
FIG. 13 shows the measured envelope correction coefficient of the coupled antennas with/without the decoupling network according to the present application.

-continued where $$\vec{E}_1(\theta,\phi)\cdot\vec{E}_2(\theta,\phi)=E_{\theta 1}(\theta,\phi)E_{\theta 2}^*(\theta,\phi)+E_{\phi 1}(\theta,\phi)E_{\phi 2}^*(\theta,\phi)$$

where $\vec{E}_1(\theta,\phi)$ is the electric field radiated by antenna 1 with antenna 2 terminated by a matched load. Similarly, $\vec{E}_2(\theta,\phi)$ is generated by antenna 2 with antenna 1 terminated by a matched load. It is known that a lower envelope correlation leads to a better diversity gain. In this example, $\vec{E}_1(\theta,\phi)$ and $\vec{E}_2(\theta,\phi)$ are measured by instrument. The obtained envelope correlation coefficient $\rho_e$ is shown in FIG. 13. As demonstrated by FIG. 13, the decoupled antenna array has its correlation improved by more than 10 dB over a wide frequency band and a maximum of 19 dB near the center frequency as compared to its coupled array counterpart.

Dual-Band Decoupling Networks

The decoupling network according to the present application can also be extended to work at multiple frequency bands.

Figure 14:
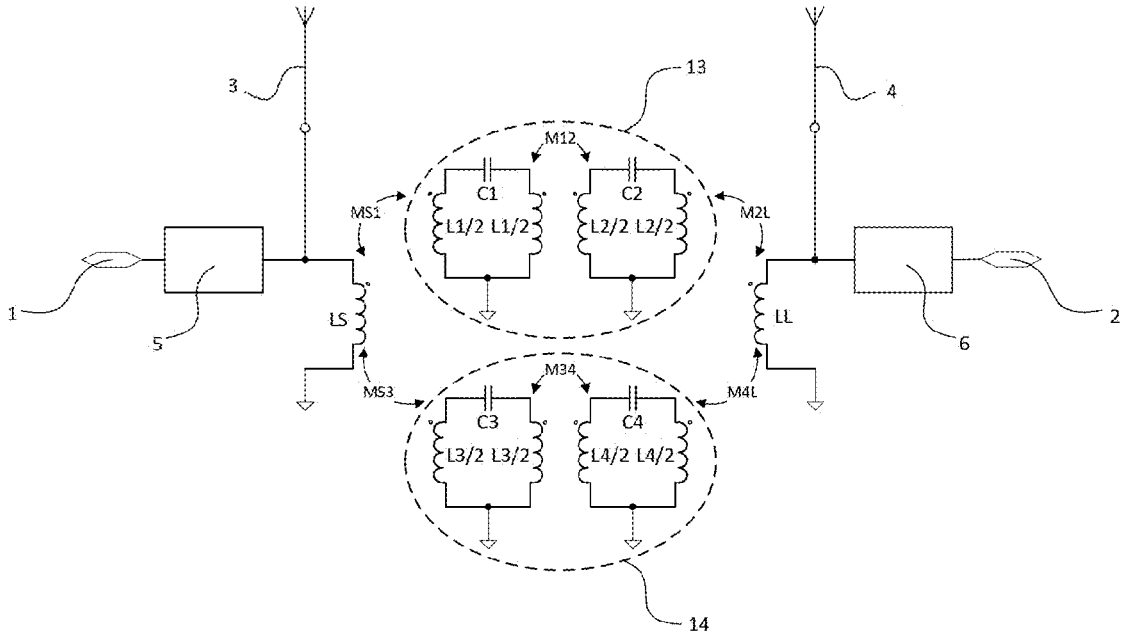
FIG. 14 illustrates a schematic configuration of another embodiment according to the present application. One method to achieve dual-band decoupling for two coupled antennas is addressed.
Figure 15:
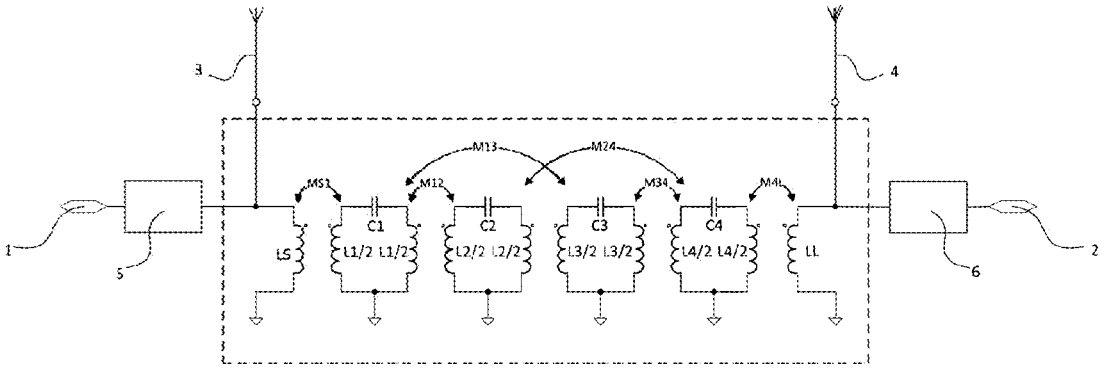
FIG. 15 illustrates a schematic configuration of another embodiment according to the present application. Another method to achieve dual-band decoupling for two coupled antennas is addressed.
Figure 16:
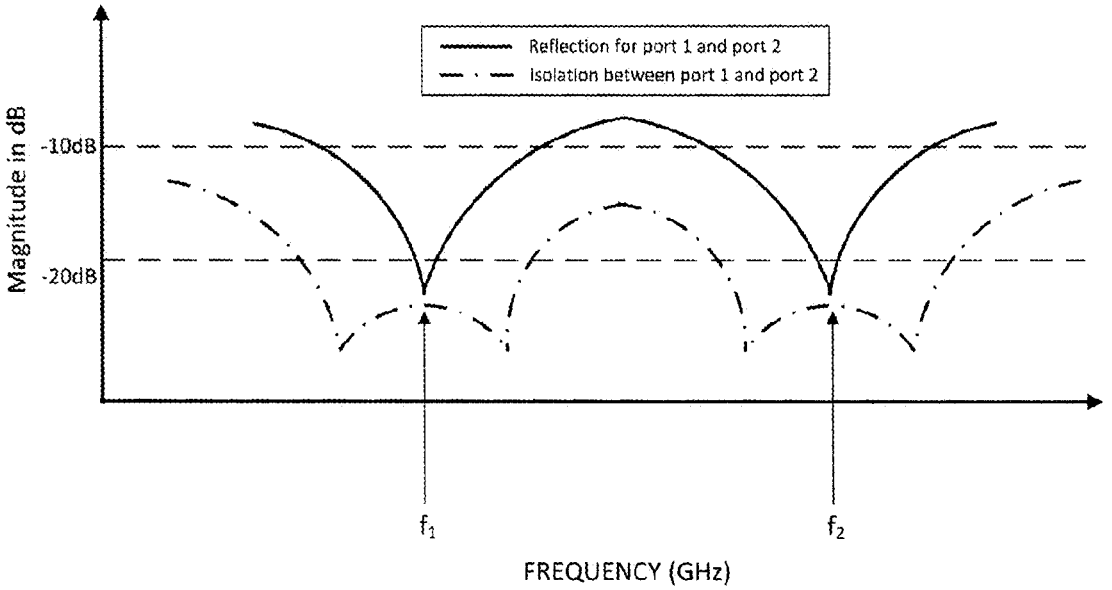
FIG. 16 shows expected decoupling and matching results for a dual-band decoupled symmetrical antenna array for illustrative purpose.

Two types of dual band prototypes are shown in FIG. 14 and FIG. 15 respectively, with the expected responses shown in FIG. 16. In FIG. 14, the first two coupled resonators 13 work at center frequency $f_1$ in FIG. 16 and the second two coupled resonators 14 work at center frequency $f_2$ in FIG. 16. For each frequency band, the design principles are the same as in the previous single band case. One only needs to design one decoupling network at $f_1$ and another at $f_2$ then couple them to the same source and load as shown in FIG. 14.

In particular, the coupling coefficient between the source and the third resonator, the coupling coefficient between the third and fourth resonators, and the coupling coefficient between the fourth resonator and the load are adjusted to satisfy with the constraint that, at both frequency bands centralized by the frequencies $f_1$ and $f_2$, isolation coefficients in the whole network approach zero, while reflection coefficients of each port of the whole network are minimized.

Similarly, for an asymmetrical antenna array, self-coupling coefficients of the resonators may be further adjusted. For coupled antennas in severe conditions, coupling coefficient between the source and the second/fourth resonator, the coupling coefficient between the first/third resonator and the coupling coefficient between the source and load may be further adjusted to achieve better decoupling.

The second dual band prototype in FIG. 15 needs four resonators as well. However, these resonators resonate at the same frequency that is generally between $f_1$ and $f_2$. The coupling coefficients need to be considered include:

- $m_{S1}$: The coupling coefficient between the source and the resonator 1;
- $m_{12}$: The coupling coefficient between the resonator 1 and resonator 2;
- $m_{34}$: The coupling coefficient between the resonator 3 and resonator 4;
- $m_{4L}$: The coupling coefficient between the resonator 4 and the load;
- $m_{13}$: The coupling coefficient between the resonator 1 and resonator 3;
- $m_{24}$: The coupling coefficient between the resonator 2 and resonator 4.

By a simple optimization, one can find many sets of suitable coupling coefficients that can decouple the two antennas at both $f_1$ and $f_2$.

Similarly, for an asymmetrical antenna array, self-coupling coefficients of the resonators may be further adjusted. For coupled antennas in severe conditions, coupling coefficient between the source and the second/fourth resonator, the coupling coefficient between the first/third resonator and the coupling coefficient between the source and load may be further adjusted to achieve better decoupling.

Three-Port Decoupling Networks for Three Coupled Antennas

Figure 17:
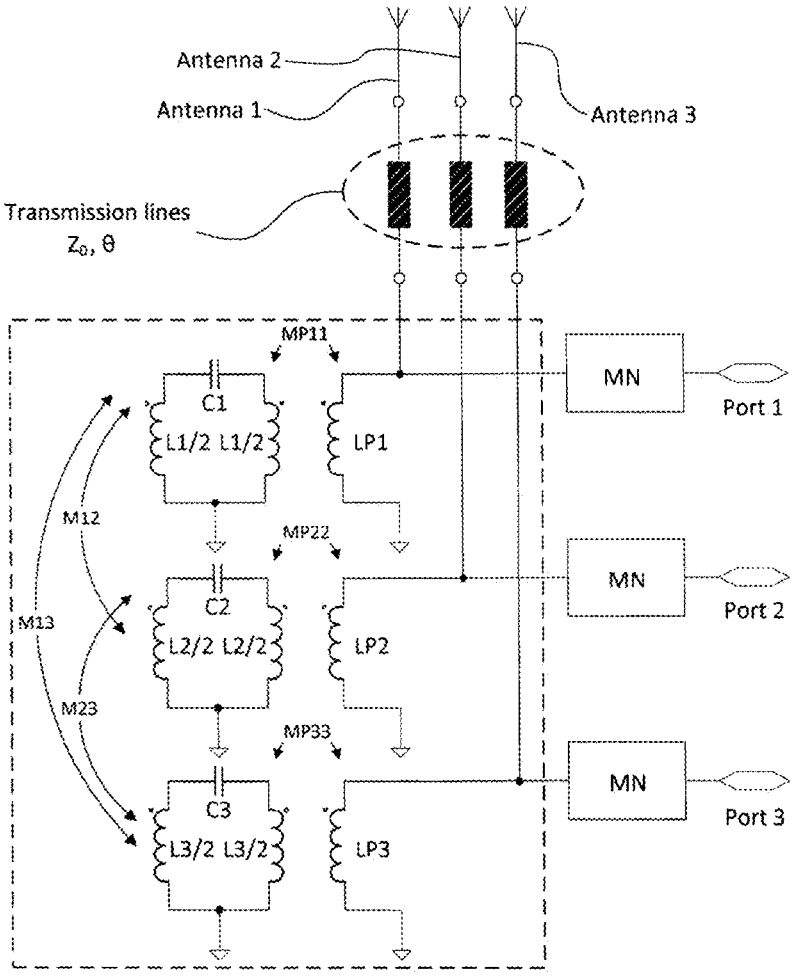
FIG. 17 illustrates a schematic configuration of another embodiment according to the present application. The three element decoupling method is addressed.

The decoupling methods and devices for two coupled antennas can be extended to decouple three-element circular array, with the circuit/network model shown in FIG. 17. For symmetrical three-element array, three identical sections of transmission lines are first added to the antennas and then a three port network is designed. Due to its symmetry in array configurations, three sets of identical coupling coefficients are considered. They are:

The input/output couplings: $m_{p11}$, $m_{p22}$ and $m_{p33}$;

The inter-resonator couplings: $m_{12}$, $m_{23}$, $m_{31}$.

Same as the decoupling network for two antennas, the inter-resonator couplings have to be as large as possible to ensure a broadband performance. Then, the input/output couplings are designed according to the characteristics of the admittances parameters of different antenna arrays so that isolation coefficients in the whole network approach zero, while reflection coefficients of each port of the whole network are minimized.

Since two resonators are bypassed in the decoupling network, second-order decoupling responses are expected. Extra matching networks can further broaden the matching bandwidth. The response in FIG. 5 can be achieved for each two antenna pairs in the three-element array.

It is noted that the decoupling network according to the present application may also extended to be applicable for decoupling more than three antennas in an antenna array.

It is understood for those skilled in the art that embodiments described herein are illustrative, but not limited. Technical features disclosed in various embodiments can be combined in any appropriate ways. Various modifications and variations of the described embodiments can be made within the scope and spirit of the present application.

What is claimed is:

1. A device for decoupling two antennas in a compact antenna array, comprising:

a first resonator coupled with a source, the source being connected with a first antenna of the two antennas; and a second resonator coupled with the first resonator and a load, the load being connected with a second antenna of the two antennas, wherein the first and second resonators are lumped element resonators that are configured so that a first coupling between the source and the first resonator, a second coupling between the first and second resonators, and a third coupling between the second resonator and the load are satisfied with a constraint that an isolation coefficient in a whole network composed of a first two-port network consisting of the two antennas and a second two-port network consisting of the first and second resonators in parallel approaches zero as well as reflection coefficients of each port of the whole network are minimized.

2. The device according to claim 1, wherein the first and second resonators are further configured so that a first self-coupling of the first resonator and a second self-coupling of the second resonator are satisfied with the constraint.

3. The device according to claim 2, wherein the second coupling between the first and second resonators is fixed while couplings except for the second coupling are adjustable so that the device is implemented as a one-fit-all universal component which is applicable for antennas with different parameters from each other.

4. The device according to claim 1, wherein the first and second resonators are further configured so that at least one of a fourth coupling between the source and the load, a fifth coupling between the source and the second resonator, and a sixth coupling between the first resonator and the load are satisfied with the constraint.

5. The device according to claim 4, wherein the second coupling between the first and second resonators is fixed while couplings except for the second coupling are adjustable so that the device is implemented as a one-fit-all universal component which is applicable for antennas with different parameters from each other.

6. The device according to claim 1, further comprising a first transmission line inserted between the first antenna and the source and a second transmission line inserted between the second antenna and the load.

7. The device according to claim 1, further comprising a first matching network added at an input port and a second matching network added at an output port of the whole network.

8. The device according to claim 1, wherein the device is implemented by substrate technologies such as low temperature co-fired ceramic (LTCC) or multi-layered printed circuit board (PCB).

9. The device according to claim 1, wherein the second coupling between the first and second resonators is fixed while couplings except for the second coupling are adjustable so that the device is implemented as a one-fit-all universal component which is applicable for antennas with different parameters from each other.

10. The device according to claim 1, further comprising:

a third resonator coupled with the source; and a fourth resonator coupled with the third resonator and the load, wherein the first and second resonators work at a first frequency band, the third and fourth resonators work at a second frequency band different from the first frequency band, and coupling coefficients in the device are optimized so that decoupling of the antennas are achievable at both the first frequency band and the second frequency band.

11. The device according to claim 1, further comprising:

a third resonator coupled with the second resonator and the first resonator a fourth resonator coupled with the second resonator, the third resonator and the load, wherein the third and fourth resonators work at a same frequency band as the first and second resonators between center frequencies of the two antennas, and coupling coefficients in the device are optimized so that decoupling of the antennas are achievable at both operating frequency bands of the two antennas.

12. The device according to claim 1, wherein the device is inserted between each pair of antennas in a multiple antenna array for decoupling said each pair of antennas in the array.

13. A device for decoupling a plurality of antennas in a compact antenna array, comprising:

a plurality of resonators, each of which is a lumped element resonator coupled with a respective port connected with each of the plurality antennas, wherein coupling coefficients in the device are adjusted to satisfy with a constraint that isolation coefficients in a whole network composed of a first multi-port network consisting of the compact antenna array and a second multi-port network consisting of the plurality of resonators in parallel approach zero as well as reflection coefficients of each port of the whole network are minimized.

14. An antenna array comprising a plurality of antennas and a decoupling device arranged between at least two of the plurality of antennas, wherein the decoupling device comprising:

a first resonator coupled with a source, the source being connected with a first antenna of the two antennas; and a second resonator coupled with the first resonator and a load, the load being connected with a second antenna of the two antennas, wherein the first and second resonators are lumped element resonators that are configured so that a first coupling between the source and the first resonator, a second coupling between the first and second resonators, and a third coupling between the second resonator and the load are satisfied with a constraint that an isolation coefficient in a whole network composed of a first two-port network consisting of the two antennas and a second two-port network consisting of the first and second resonators in parallel approaches zero as well as reflection coefficients of each port of the whole network are minimized.

15. The antenna array according to claim 14, wherein the first and second resonators are further configured so that a first self-coupling of the first resonator and a second self-coupling of the second resonator are satisfied with the constraint.

16. The antenna array according to claim 14, wherein the first and second resonators are further configured so that at least one of a fourth coupling between the source and the load, a fifth coupling between the source and the second resonator, and a sixth coupling between the first resonator and the load are satisfied with the constraint.

17. The antenna array according to claim 14, the decoupling device further comprising:

a third resonator coupled with the source; and a fourth resonator coupled with the third resonator and the load, wherein the first and second resonators work at a first frequency band, the third and fourth resonators work at a second frequency band different from the first frequency band, and coupling coefficients in the device are optimized so that decoupling of the antennas are achievable at both the first frequency band and the second frequency band.

18. The antenna array according to claim 14, the decoupling device further comprising:

a third resonator coupled with the second resonator and the first resonator; and a fourth resonator coupled with the second resonator, the third resonator and the load, wherein the third and fourth resonators work at a same frequency band as the first and second resonators between center frequencies of the two antennas, and coupling coefficients in the device are optimized so that decoupling of the antennas are achievable at both operating frequency bands of the two antennas.

19. An antenna array comprising a plurality of antennas and a decoupling device comprising a plurality of resonators, wherein each of the plurality resonators is a lumped element resonator coupled with a respective port connected with each of the plurality antennas, wherein coupling coefficients in the device are adjusted to satisfy with a constraint that isolation coefficients in a whole network composed of a first multi-port network consisting of the compact antenna array and a second multi-port network consisting of the plurality of resonators in parallel approach zero as well as reflection coefficients of each port of the whole network are minimized.

20. A method for decoupling two antennas in a compact antenna array, comprising:

coupling a first resonator with a source connected with a first antenna of the two antennas;

coupling a second resonator with the first resonator and a load connected with a second antenna of the two antennas, wherein the first resonator and the second resonator are lumped element resonators, and adjusting a first coupling between the source and the first resonator, a second coupling between the first and second resonators, and a third coupling between the second resonator and the load under a constraint that an isolation coefficient in a whole network composed of a first two-port network consisting of the two antennas and a second two-port network consisting of the first and second resonators in parallel approaches zero as well as reflection coefficients of each port of the whole network are minimized.

21. The method according to claim 20, further comprising:

adjusting a first self-coupling of the first resonator and a second self-coupling of the second resonator to satisfy with the constraint.

22. The method according to claim 20, further comprising:

adjusting at least one of a fourth coupling between the source and the load, a fifth coupling between the source and the second resonator, and a sixth coupling between the first resonator and the load to satisfy with the constraint.

* * * * *